US006956336B2

(12) United States Patent
Ribarich

(10) Patent No.: US 6,956,336 B2
(45) Date of Patent: Oct. 18, 2005

(54) SINGLE CHIP BALLAST CONTROL WITH POWER FACTOR CORRECTION

(75) Inventor: Thomas J. Ribarich, Laguna Beach, CA (US)

(73) Assignee: International Rectifier Corporation, El Segundo, CA (US)

( * ) Notice: Subject to any disclaimer, the term of this patent is extended or adjusted under 35 U.S.C. 154(b) by 0 days.

(21) Appl. No.: 10/615,710

(22) Filed: Jul. 8, 2003

(65) Prior Publication Data

US 2004/0012347 A1 Jan. 22, 2004

Related U.S. Application Data

(60) Provisional application No. 60/398,208, filed on Jul. 22, 2002.

(51) Int. Cl.[7] ..... H05B 41/16

(52) U.S. Cl. ..... 315/247; 315/224; 315/291

(58) Field of Search ..... 315/247, 291, 315/307, 224, 209 R, DIG. 2, DIG. 4, DIG. 5, DIG. 7

(56) References Cited

U.S. PATENT DOCUMENTS 5,315,214 A * 5/1994 Lesea ..... 315/209 R
5,612,597 A * 3/1997 Wood ..... 315/291
6,008,593 A * 12/1999 Ribarich ..... 315/224
6,211,623 B1 * 4/2001 Wilhelm et al. ..... 315/224
6,259,614 B1 7/2001 Ribarich et al. ..... 363/89
6,469,917 B1 * 10/2002 Ben-Yaakov ..... 363/89
6,555,971 B1 * 4/2003 Lestician ..... 315/224
6,617,805 B2 * 9/2003 Ribarich et al. ..... 315/247
2002/0141129 A1 * 10/2002 Ribarich ..... 361/130

* cited by examiner

*Primary Examiner*—Wilson Lee
*Assistant Examiner*—Ephrem Alemu
(74) *Attorney, Agent, or Firm*—Ostrolenk, Faber, Gerb & Soffen, LLP

(57) ABSTRACT

An integrated circuit provides a complete electronic ballast control with power factor correction for fluorescent lamps. The integrated circuit contains a simplified power factor correction (PFC) circuit to reduce component count and supply voltage requirements to reduce manufacturing costs while providing a robust control. The PFC circuit has a variable gain for fast response at high gain and optimized power factor control at low gain. An increased on time for the PFC switch when the input line voltage approaches zero dynamically reduces crossover distortion, thereby reducing total harmonic distortion. The integrated circuit incorporates a number of fault protections.

16 Claims, 8 Drawing Sheets

PRIOR ART

SINGLE CHIP BALLAST CONTROL WITH POWER FACTOR CORRECTION

RELATED APPLICATION

The application is based on and claims benefit of U.S. Provisional Application No. 60/398,208, filed on Jul. 22, 2002, entitled Single Chip Ballast Control with Power Factor Correction, to which a claim of priority is hereby made.

BACKGROUND OF THE INVENTION

1. Field of the Invention

The present invention relates generally to ballast controllers, and relates more particularly to ballast control for gas discharge lamps with power factor correction.

2. Description of Related Art

Ballasts have been used for many years as part of lighting systems and gas discharge lamps, and in particular for fluorescent lamps. Fluorescent lamps pose a load control problem to the power supply lines that provide lamp power, because the lamp load is non-linear. Current through the lamp is zero until an applied voltage reaches a starting value, at which point the lamp begins to conduct. As the lamp begins to conduct, the ballast ensures that the current drawn by the lamp does not increase rapidly, thereby preventing damage and other operational problems.

A type of electronic ballast typically provided includes a rectifier to change the alternating current (AC) supplied by a power line to direct current (DC). The output of the rectifier is typically connected to an inverter to change the direct current into a high frequency AC signal, typically in the range of 25–60 kHz. The high frequency inverter output to power the lamp permits the use of inductors with much smaller ratings than would otherwise be possible, and thereby reduces the size and cost of the electronic ballast.

Often, a power factor correction circuit is inserted between the rectifier and the inverter to adjust the power factor of the lamp circuit. Ideally, the load in an AC circuit should be equivalent to pure resistance to obtain the most efficient power delivery for the circuit. The power factor correction circuit is typically a switched circuit that transfers stored energy between storage capacitors and the circuit load. The typical power inverter circuit also employs switching schemes to produce high frequency AC signal output from the low frequency DC input. Switching within the power factor correction circuit and the rectifier circuit can be accomplished with a digital controller.

By controlling the switching in the power inverter circuit, operating parameters of the lamp such as starting, light level regulation and dimming can be reliably controlled. In addition, lamp operating parameters can be observed to provide feedback to the controller for detection of lamp faults and proper operational ranges.

A diagram of a conventional electronic ballast circuit is shown generally as circuit 18 in FIG. 1. A power factor correction (PFC) circuit 20 accepts a line input and provides regulated power to an output stage 22. PFC circuit 20 provides a sinusoidal input current to output stage 22, while also providing a regulated DC bus voltage. Output stage 22 receives the regulated power signal from PFC circuit 20, and provides appropriate control for powering lamp 26. Output stage 22 includes the components and operational ability for preheating, igniting and regulating power to lamp 26.

PFC circuit 20 is typically realized as a boost-type converter that requires a high voltage switch, an inductor, a diode, a high voltage DC bus capacitor and an associated control circuit to produce the desired power signals with the components provided. Output stage 22 is typically realized with a half-bridge driven resonant load to provide appropriate power to lamp 26. Output stage 22 typically requires two high voltage switches, a resonant inductor, a resonant capacitor, a DC-blocking capacitor and an associated control circuit for regulating circuit resonance and power delivery. A block 24 provides a representative diagram of such a conventional control.

In the conventional configuration shown in FIG. 1, a switch Mpfc, a diode Dpfc and an inductor Lpfc are connected in a boost type arrangement. The PFC circuit components Lpfc, Mpfc and Dpfc are operated to charge Cbus during an initial stage, such as during a power-on state. Upon being charged, bus capacitor Cbus supplies power to half-bridge resonant output stage 22 for the remainder of the operation of the circuit. By supplying power to output stage 22, bus capacitor Cbus is rated for high capacitance and high voltage operation, thereby increasing the cost and size of the electronic ballast circuit. In addition, switches M1, M2 are also rated for high voltage operation, and therefore have increased cost and size as well.

A number of faults can occur in the conventional electronic ballast circuit shown in FIG. 1. For example, overcurrent conditions can occur on the input power line and on the output to lamp 26. In addition, undervoltage conditions can occur on the DC bus. With regard to lamp 26, various faults can occur including failure to strike, physical removal of lamp 26 or when lamp 26 approaches the end of its useful life.

Aside from the above-mentioned faults, the ballast circuit in FIG. 1 can have different operational characteristics based on the tolerances of the components that make up the circuit. Tolerances of the components can also change over time, making it difficult to provide a robust ballast control with good PFC characteristics.

In addition t the above drawbacks, the ballast circuit of FIG. 1 uses 3 control IC's, 21, 23 and 24. Control IC 21 controls switching in PFC stage 20 to correctly modulate the input current to provide good power factor characteristics. Control IC 23 provides overall control of the ballast, including providing control signals to control IC 24. Control IC 24 provides switching signals for the half-bridge composed of M1 and M2 to regulate power delivered to lamp 26. The use of 3 separate control ICs to control the ballast increases the circuit complexity and cost.

SUMMARY OF THE INVENTION

The present invention provides a flexible ballast control with power factor correction and a number of circuit and lamp protections on a single IC. For example, undervoltage conditions are detected and the ballast control is placed in a safe mode that maintains functionality while preventing activation of the ballast drivers. The ballast controller provides a preheat mode and an ignition mode for starting the lamp, as well as a run mode for operating the lamp in an ON state.

The controller incorporates feedback detection and protects against low voltage on the DC bus, and detects and protects against faults that originate with the lamp reaching an end of life state. The controller also senses current and protects against over-current conditions.

A power factor correction section in the controller operates to provide a sinusoidal line input current in phase with the input voltage for high power factor as seen from the input power source. The power factor circuit is programmable based on a selection of components, and can detect and protect against a number of power faults. The power factor correction circuit also maintains total harmonic distortion at low levels, especially near input voltage zero crossings.

The ballast control is fully integrated and capable of driving all types of fluorescent lamps. The PFC circuitry operates in critical conduction mode and provides high power factor, low total harmonic distortion, as well as DC bus regulation. The ballast control is programmable and includes programmable features including programmable preheat and run frequencies, preheat time, dead time, overcurrent protection and end-of-life protection. Safety and protective features include protection from failure of a lamp to strike, filament failures, end of life protection, DC bus under-voltage reset and automatic restart. The control simplifies the ballast design and reduces the cost of the overall ballast system.

BRIEF DESCRIPTION OF THE DRAWINGS

The present invention will be better understood with the following detailed description read in conjunction with the drawings, in which.

DETAILED DESCRIPTION OF THE PREFERRED EMBODIMENTS

Figure 1:
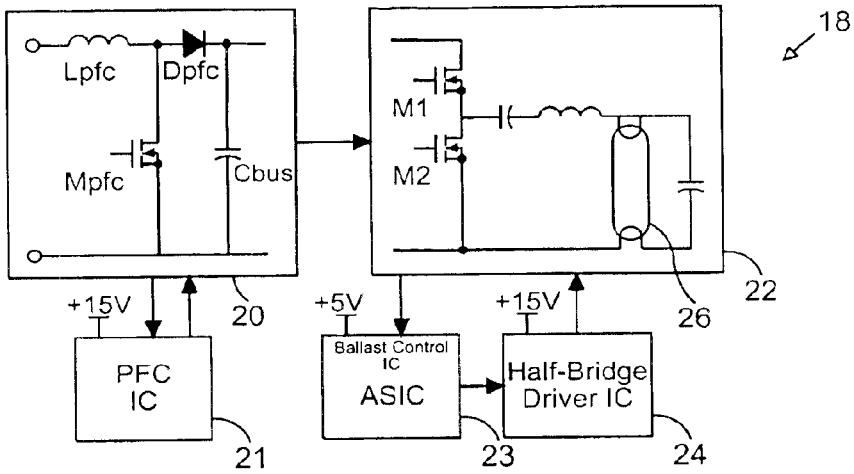
FIG. 1 is a conventional electronic ballast circuit with power factor correction.

Referring now to FIG. 1, a conventional lamp ballast control circuit 18 is shown. Ballast circuit 18 is composed of two stages, a power factor correction (PFC) stage 20, and a lamp drive circuit stage 22. PFC stage 20 is controlled by an integrated circuit 21 and produces control signals for power factor correction. Ballast output stage 22 is controlled by a half-bridge driver integrated circuit 24. Driver 24 provides control signals to components in ballast output stage 22 to drive the ballast to provide appropriate lamp lighting control. Driver 24 also receives signals from a ballast control integrated circuit 23. Status and monitoring signals from ballast output stage 22 are directed to ballast control 23. With the feedback signals from ballast output stage 22, ballast control 23 derives control signals to feed to driver 24 to control ballast stage 22. In this conventional arrangement, PFC control, ballast control and half-bridge driver control are embodied in three separate integrated circuits.

Figure 2:
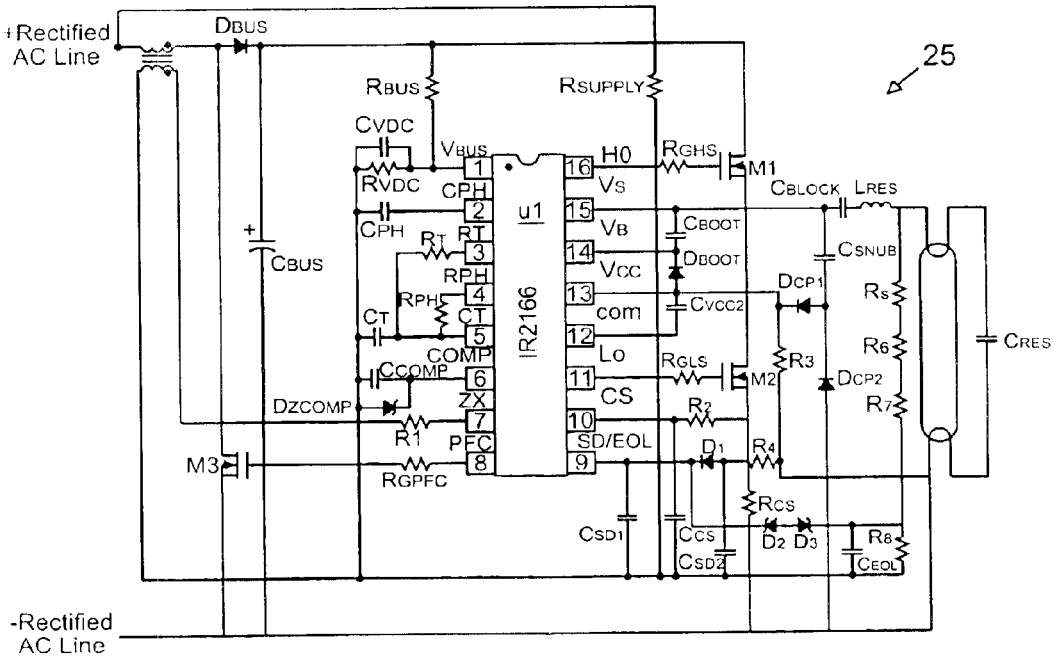
FIG. 2 is a circuit diagram showing component connection for operation of a lamp according to the present invention.

Referring now to FIG. 2, according to the present invention, a circuit diagram for a ballast controller that incorporates power factor correction is illustrated generally as circuit 25. Circuit 25 has three MOSFET switches, M1, M2 and M3 for driving the various stages of the ballast control. Switches M1 and M2 comprise the half-bridge used to drive the ballast output and control the lamp power. Switch M3 controls the power factor correction for ballast control circuit 25. The PFC circuit operates in critical conduction mode to give a high power factor with a low total harmonic distortion. During each switching cycle, switch M3 is operated to turn on when the inductor current is discharged to zero, thereby obtaining rapid response and good DC bus regulation for the PFC circuit. Integrated circuit (IC) U1 is, for example, illustrated as a product of International Rectifier Corporation, the details of which are available in IR-2166 data sheet, the contents of which are hereby incorporated by reference in their entirety. IC U1 provides programmable control for the lamp ballast, and can be programmed to provide designated frequencies for preheat and normal operation. The preheat time can be programmed, in addition to dead time for circuit switching, over-currcnt protection operation and end-of-life and fault protection. IC U1 also provides other protective features such as protection against failure of the lamp to strike, failure of a lamp filament, lamp end-of-life protection, DC bus under-voltage reset operation, as well as an automatic restart function.

Figure 3:
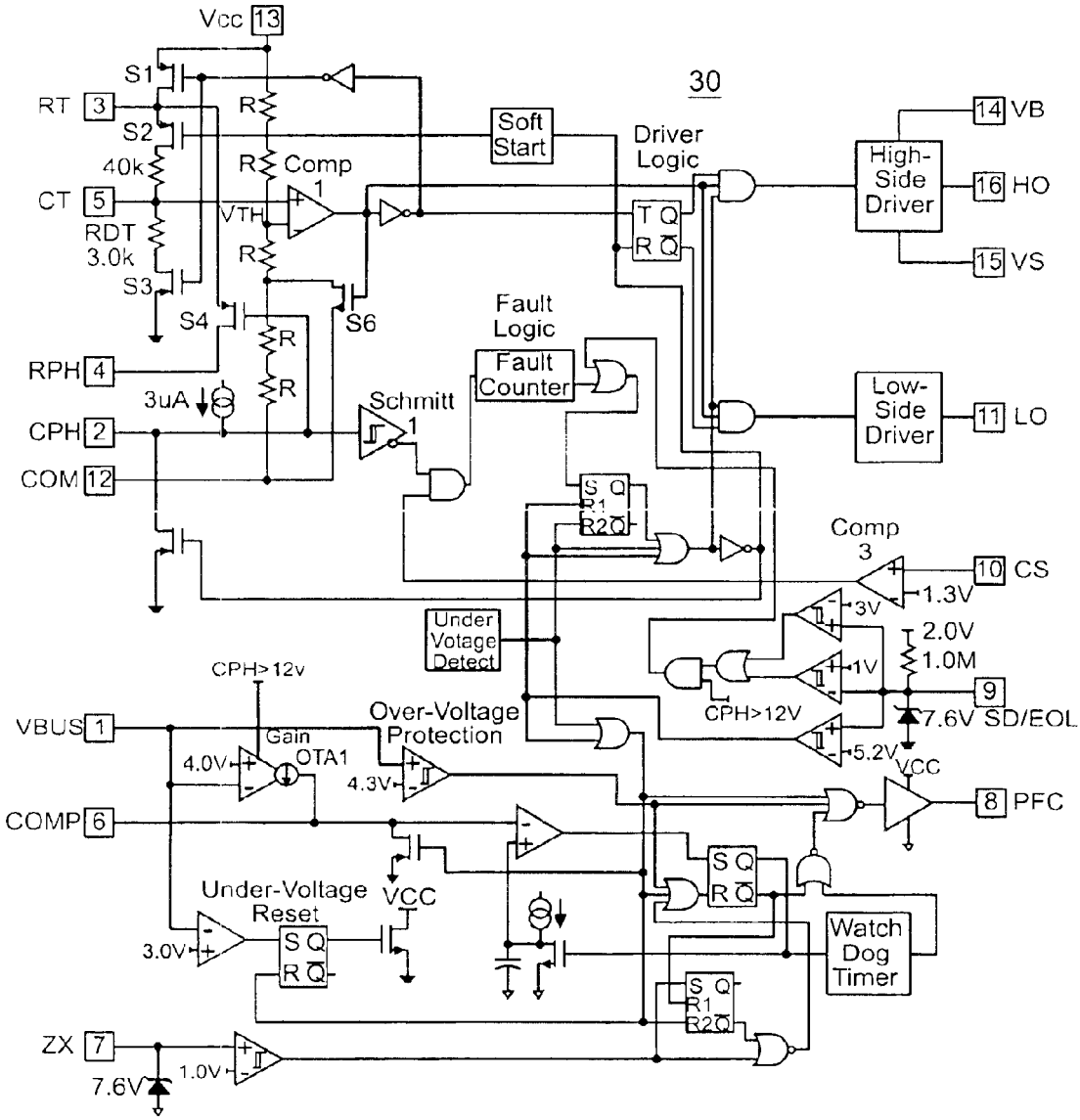
FIG. 3 is a circuit block diagram of the electronic ballast according to the present invention.

Referring now to FIG. 3, a block diagram of IC U1 is illustrated generally as diagram 30. The various portions of diagram 30 provide the features of the present invention are explained below according to their various functions. The control operation and features of the present invention are explained in terms of state machine operation, depending upon the status of the ballast and lamp.

Figure 4:
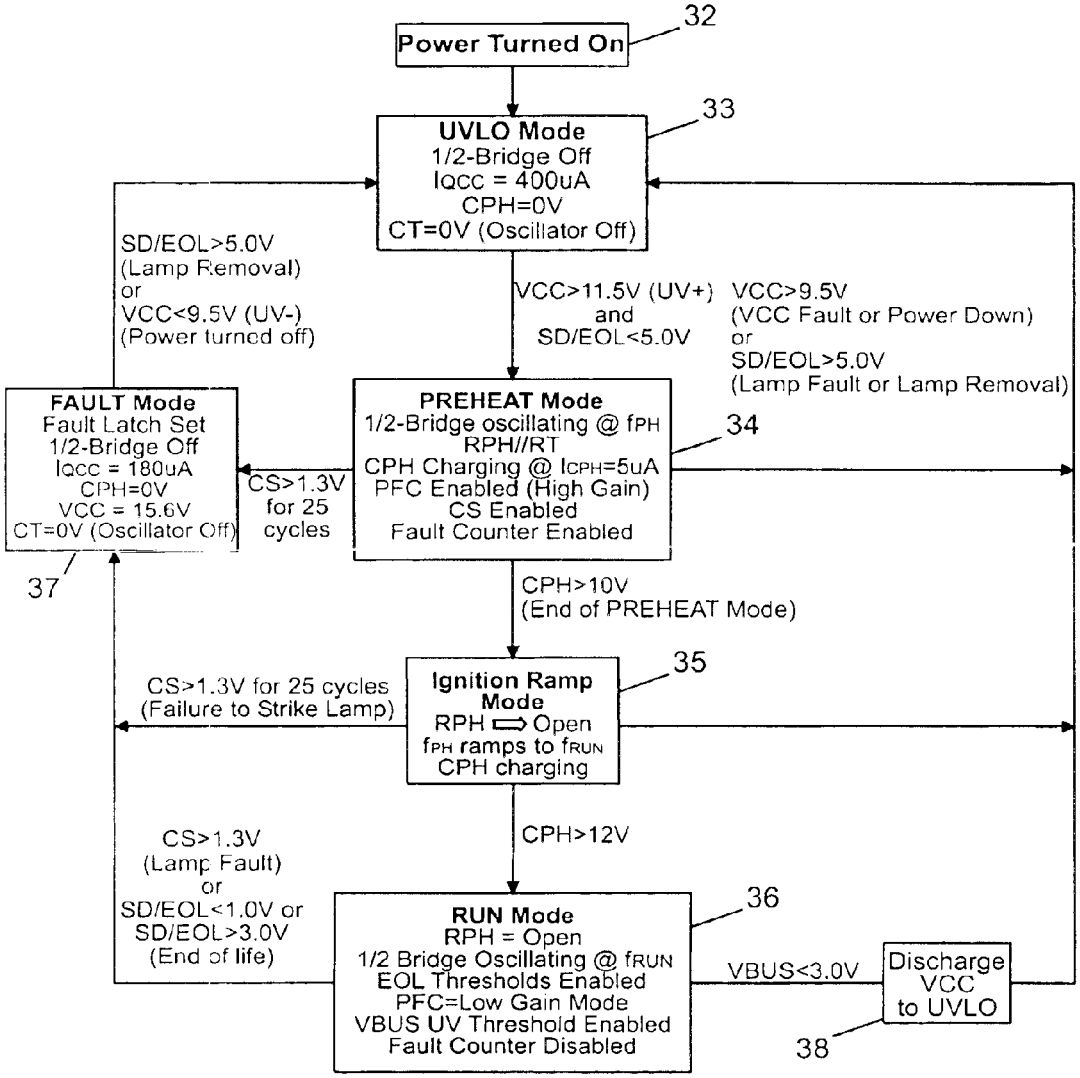
FIG. 4 is a state machine diagram for operation of the ballast circuit according to the present invention.

Refening now to FIG. 4, a state machine diagram is illustrated showing operation of the ballast control with a given fluorescent lamp. In a state 32, power is applied to IC U1, which can be wired into ballast control circuit 25 as illustrated in FIG. 2. Circuit 25 can also be provided on a ballast control card as described in U.S. application Ser. No. 10/309,359, filed Dec. 2, 2002. When power is applied to integrated circuit U1, the state machine illustrated in FIG. 4 moves to state 33, which provides various initialization and start-up checks and operations. In state 33, an under-voltage lock-out mode is established when VCC is below the turn-on threshold of IC U1. In this mode, the output drivers for switches M1 and M2 are deactivated. When IC U1 is in UVLO mode, the circuit maintains a very low supply current, for example, less than 400 $\mu$A. The low supply current permits IC U1 to function and verify various circuit conditions before operating the switches M1 and M2. In addition, state 33 shows the preheat time signal deactivated, and the oscillator is disabled. IC U1 leaves state 33 once VCC has reached the appropriate threshold, for example, 11.5 volts, and there are no lamp faults detected.

IC U1 moves from state 33 to state 34, once the circuit has exited the UVLO mode. IC U1 enters preheat mode in state 34, in which the oscillator is activated to switch switches M1 and M2 at the preheat frequency. Power factor correction is enabled, as well over-current protection to protect against a non-striking lamp or an open filament lamp fault condition. Once the preheat capacitor CPH charges to greater than 10 volts, for example, IC U1 moves into state 35.

In state 35, the lamp is ignited and the circuit enters run mode. The lamp is driven to a given power level through oscillation of switches M1 and M2 beyond the oscillation frequency and for preheating. The resistor RPH for preheating is smoothly disconnected, and once capacitor CPH is charged to greater than 12 volts, IC U1 moves to state 36. The various fault protections are enabled, as illustrated in state 36, and the power factor correction circuit is operated at a lower gain to maintain a high power factor while preserving a low total harmonic distortion. Resistor RPH is totally disconnected in state 36 and switches M1 and M2 are oscillated at a run frequency to obtain a specified power output.

In the event a fault occurs, either during ignition state 35 or run mode state 36, fault mode state 37 is entered, which provides various safety and protection features for the ballast circuit. Faults that can cause the control to enter fault mode in state 37 include the lamp failing to strike, the lamp experiencing a fault or the lamp reaching the end of its useful life. In fault mode, the half-bridge comprised of switches M1 and M2 is turned off, as well as the oscillator for controlling the switches. The power factor correction switch M3 is also turned off, and the circuit enters a low current draw state, for example 180 $\mu$A. A fault latch is also set to enunciate the fact that an error occurred. If the fault is corrected, for example, after the power is cycled and no fault occurs, or the lamp is replaced, the control returns to state 33 to initiate a reset and restart. Other faults that cause a change in state include the bus voltage dropping to below 3.0 volts, causing the control to enter a reset state in state 38. In addition, if the chip supply voltage drops below 9.5 volts, or the lamp circuit becomes discontinuous, such as when the lamp is removed or replaced, the control resets and enters the under-voltage mode in state 33.

Figure 5:
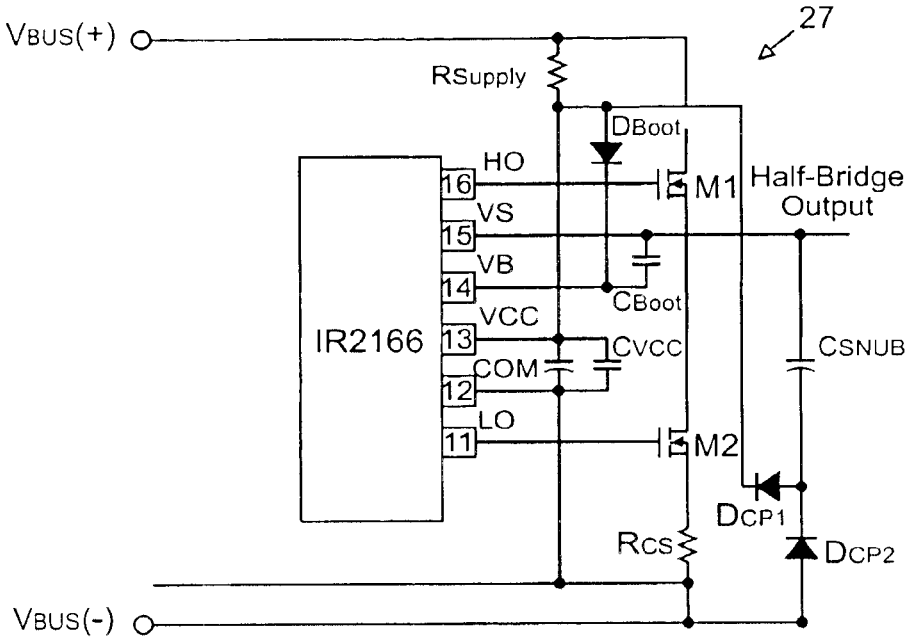
FIG. 5 is a circuit diagram to illustrate start up operation of the lamp.

Referring now to FIG. 5, an illustration of a circuit configured to use start-up and supply features of the present circuit is shown generally as circuit 27. Circuit 27 illustrates an efficient supply voltage using the low start-up current of IC U1, together with a charge pump from the ballast output stage composed of the components $R_{SUPPLY}$, $C_{VCC}$, $D_{CP1}$ and $D_{CP2}$. The start-up capacitor $C_{VCC}$ is charged by the current through supply resistor $R_{SUPPLY}$ minus the start-up current drawn by IC U1. Resistor $R_{SUPPLY}$ is chosen to set the line input voltage turn-on threshold for the ballast. Once the capacitor voltage on capacitor $C_{VCC}$ reaches the start-up threshold and pin SD of IC U1 is less than 4.5 volts, IC U1 turns on and begins to switch switches M1 and M2 through oscillating outputs HO and LO. Capacitor $C_{VCC}$ begins to discharge as the operating current of IC U1 increases.

Figure 6:
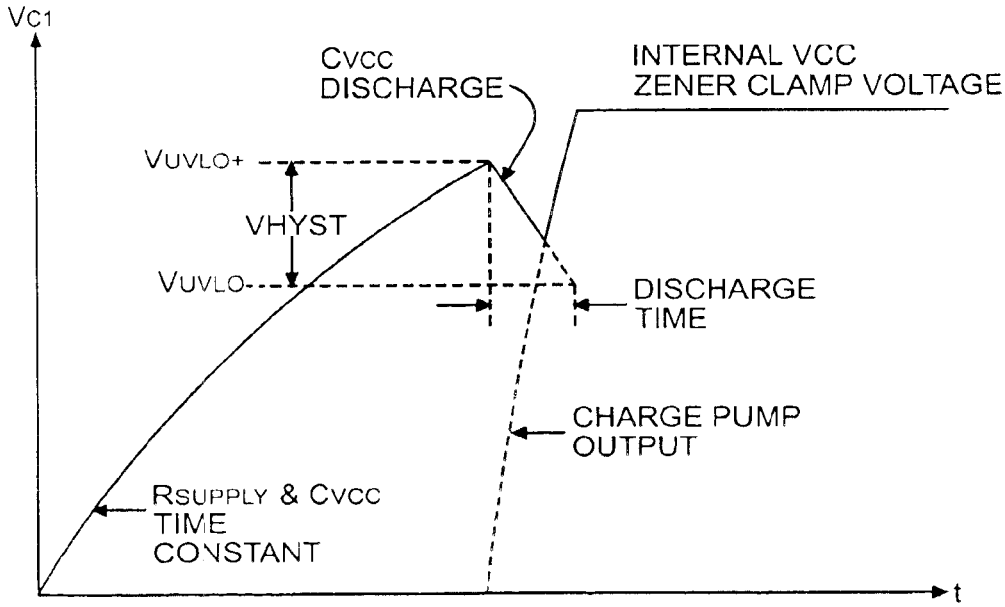
FIG. 6 is a graph showing capacitor voltage over time during a start up sequence.

Referring now to FIG. 6, a graph of the start-up voltage on capacitor $C_{VCC}$ is shown. As the IC U1 is turned on, capacitor $C_{VCC}$ begins to charge up, and continues to charge until the voltage on VCC reaches the start-up threshold, for example 11.5 volts. At this point, IC U1 turns on, and in the absence of any lamp faults, begins to drive switches M1 and M2 during the preheat mode. When VCC reaches the start-up threshold, and switches M1 and M2 begin to oscillate, capacitor $C_{VCC}$ begins to discharge due to the associated increase in operating current for IC U1. The charge pump output stage places a charge on capacitor $C_{VCC}$, which is charged by the rectified current from the charge pump. The charge pump charges the capacitor above the turn-off threshold for IC U1, as illustrated in FIG. 6. IC U1 contains an internal 15.6 volt zener diode clamp that permits the charge pump to act as the supply voltage for IC U1. The start-up capacitor $C_{VCC}$ and the snubber capacitor $C_{SNUB}$ are selected to supply enough current over all ballast operating conditions. A boot strap diode $D_{BOOT}$ and boot strap capacitor $C_{BOOT}$ comprise the supply voltage with a high side driver circuitry.

The high side supply is charged up before the first pulse on pin HO is delivered to activate switch M1. To ensure the proper high side supply charge, the first pulse from the output drivers is set to be provided on pin LO to activate switch M2. During under-voltage lock-out mode, the high and low side driver outputs HO and LO are both disabled, and the oscillator is disabled, while the preheat time is reset by internally connecting pin CPH to pin COM.

Figure 7:
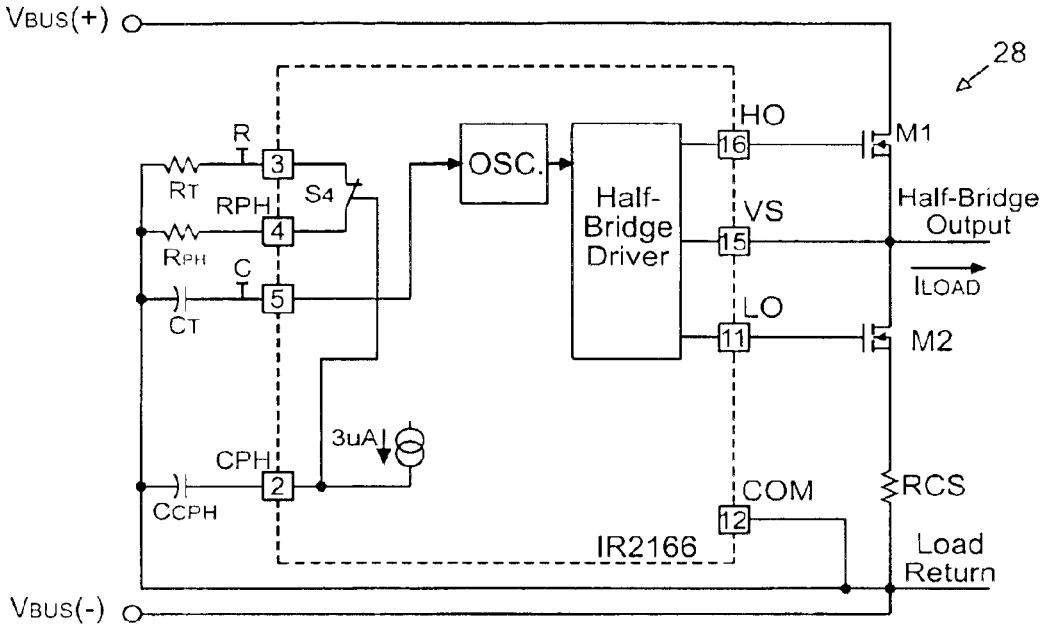
FIG. 7 is a circuit diagram to illustrate preheating operation of the lamp.

Referring now to FIG. 7, a diagram for operating the preheat circuitry according to the present invention is shown generally as circuit 28. Preheat mode is defined as the state that IC U1 is in when the lamp filaments are being heated to their correct emission temperature. Heating the lamp filaments provides for maximizing lamp life and reducing required ignition voltage. Circuit 28 enters preheat mode when the supply voltage on pin VCC exceeds the UVLO+ going threshold. In preheat mode, HO and LO begin to oscillate at the preheat frequency with a 50% duty cycle and a dead-time that is set by the value of the external timing capacitor $C_T$ and internal dead time resistor $R_{DT}$. Pin CPH is disconnected from COM and an internal 1 $\mu$A current source linearly charges the external preheat timing capacitor $C_{CPH}$ on pin CPH. The over-current protection on pin CS and the fault counter are both enabled during preheat mode.

Figure 8:
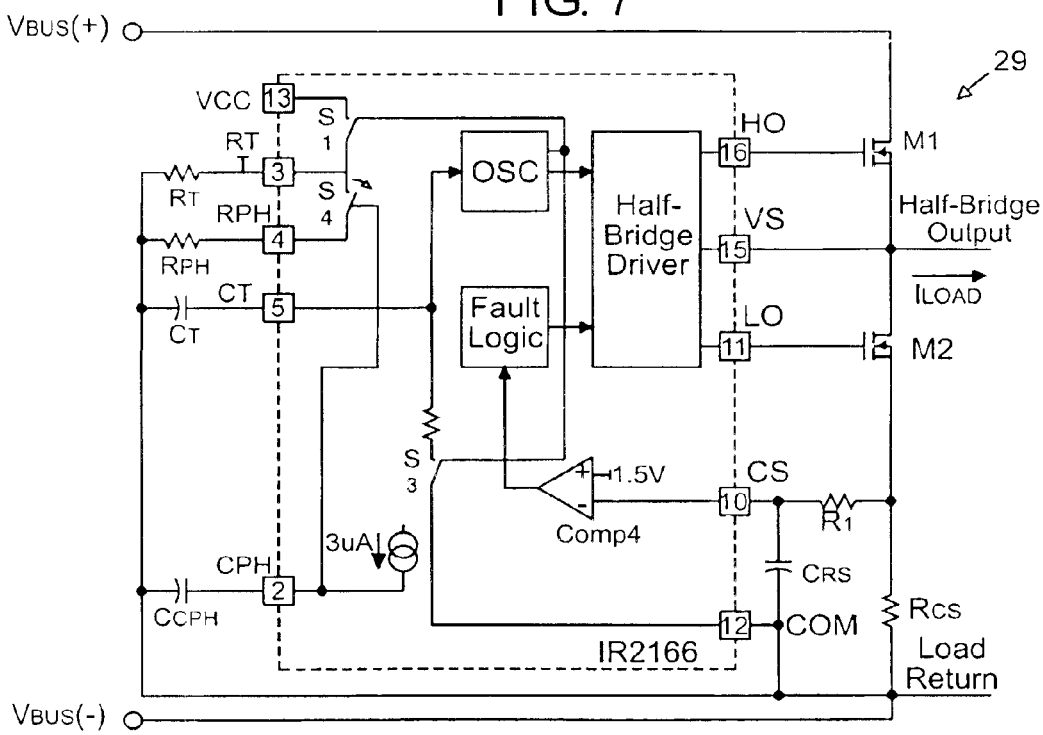
FIG. 8 is a circuit diagram to illustrate ignition operation of the lamp.

The preheat frequency is determined by the parallel combination of resistors $R_T$ and $R_{PH}$, together with timing capacitor $C_T$. Capacitor $C_T$ charges and discharges between ⅓ and ⅗ of VCC during operation. Capacitor $C_T$ is charged exponentially through the parallel combination of resistor RT and RPH connected internally to VCC through switch S1 (FIG. 8). The charge time of capacitor $C_T$ from ⅓ to ⅗ of voltage VCC is the on-time of the respective output gate driver, HO or LO. Once the voltage on capacitor $C_T$ exceeds ⅗ of VCC, switch S1 is turned off, disconnecting resistor $R_T$ and $R_{PH}$ from the voltage VCC. Capacitor $C_T$ is then discharged exponentially through an internal resistor $R_{DT}$ through switch S3 (FIG. 3). The discharge time of capacitor $C_T$ from ⅗ to ⅓ of voltage VCC is the dead-time of the output gate drivers HO and LO. The selected value of capacitor $C_T$ together with internal resistor $R_{DT}$ programs the desired dead time for switching the output drivers. Once capacitor $C_T$ discharges below ⅓ of voltage VCC, switch S3 is turned off, disconnecting resistor $R_{DT}$ from COM and switch S1 is turned on, connecting resistor $R_T$ and $R_{PH}$ again to voltage VCC. The frequency remains at the preheat frequency until the voltage on pin CPH exceeds 10 volts, for example, and IC U1 enters the ignition mode. During preheat mode, both over-current protection and the fault counter are enabled.

Referring now to FIG. 8, the ignition mode circuitry according to the present invention is shown generally as circuit 29. The ignition mode is defined as a state that IC U1 is in when a high voltage is being established across the lamp electrode to ignite the lamp. The ignition mode is entered when pin CPH is connected internally to the gate of a switch S4 to connect pin RPH with pin RT, thereby placing resistor $R_T$ and resistor $R_{PH}$ in parallel. As the voltage on pin CPH exceeds 10 volts, the gate to source voltage of switch S4 begins to fall below the turn-on threshold for switch S4. As pin CPH continues to ramp towards VCC, switch S4 turns off slowly. This results in resistor $R_{PH}$ being disconnected smoothly from resistor $R_T$, which causes the operating frequency to ramp smoothly from the preheat frequency, through the ignition frequency, to the final run frequency. The over-current threshold on pin CS protects the ballast against a non-strike or open filament lamp fault condition. The voltage on pin CS is defined by the lower half bridge switch current flowing through an external current sensing resistor $R_{CS}$. The resistor $R_{CS}$ thus programs the maximum allowable peak ignition current, and therefore, the peak ignition voltage of the ballast output stage. The peak ignition current must not exceed the maximum allowable current ratings of the output stage switches M1 and M2. If the peak ignition voltage exceeds the internal threshold of 1.3 volts, the internal fault counter begins counting the sequential over-current faults. If the number of over-current faults exceeds 60, IC U1 enters fault mode and the gate driver outputs for switches M1, M2 and M3 are disabled.

Once the lamp has successfully ignited, the ballast enters run mode. Run mode is defined as the state that IC U1 is in when the lamp arc is established and the lamp is being driven to a given power level. The run mode oscillating frequency is determined by the timing resistor $R_T$ and the timing capacitor $C_T$ connected to the pins having the same designation.

While IC U1 is operating in run mode, it is possible that the lamp may fail with an open filament, or that the lamp may be removed. In these fault situations, hard switching can occur in switches M1 or M2. To avoid this situation, a fault is registered through current sensing resistor $R_{CS}$. The voltage across current sensing resistor $R_{CS}$ exceeds the internal threshold of 1.3 volts in any of these fault conditions, and the internal fault counter will begin counting. If the number of consecutive over-current faults exceeds 60, IC U1 will enter fault mode and gate driver outputs for switches M1, M2 and M3 are disabled.

Another feature provided by the circuit of the current invention prevents potentially damaging situations that can occur when the DC bus voltage becomes too small. If the DC bus voltage decreases, for example, because of a brown-out line condition or overload condition, the resonant output stage of the lamp may operate near or below the resonance frequency. This operation can produce hard switching at the half-bridge with switches M1 and M2, potentially causing damage to switches M1 or M2. In addition, the voltage on the DC bus can decrease to the point that the lamp arc can no longer be maintained, and the lamp is extinguished. To protect the ballast circuit against these types of faults, pin VBUS (illustrated in FIGS. 2, 3) provides a 3.0 volt under-voltage threshold. If the voltage on pin VBUS decreases below 3.0 volts, VCC is discharged through an internal switch through the UVLO voltage threshold and all gate drivers for switches M1, M2 and M3 are disabled, that is, latched low.

This under-voltage reset feature of the present invention permits a lamp ballast to have a minimum rated input voltage. Once the AC line input voltage falls below the rated input voltage for the ballast, the DC bus voltage falls to a level where the voltage on pin VBUS decreases below the internal 3.0 volt threshold. Once the AC input line voltage is restored to the minimum rated input voltage, pull-up resistor $R_{SUPPLY}$ reestablishes the voltage VCC to permit the ballast to turn on again. The appropriate turn-on point for the ballast is when the AC line input voltage is high enough to cause voltage VCC to exceed UVLO+ (see FIG. 6).

Resistor $R_{SUPPLY}$ is selected to turn on the lamp ballast at the specified minimum rated ballast input voltage. The power factor correction circuit is also designed to permit the ballast to operate until the DC bus voltage decreases when the input line voltage is lower than the minimum specified ballast input voltage rating. The hysteresis provided by these considerations results in the ballast turning on and off cleanly.

Figure 9:
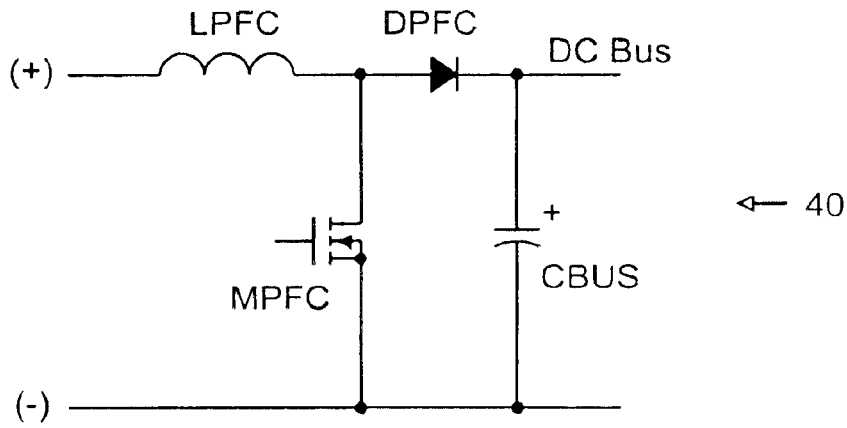
FIG. 9 is a circuit schematic to illustrate power factor correction.

Referring now to FIG. 9, a boost-type power factor correction circuit is illustrated generally as circuit 40. It is usually desirable to have an electronic ballast act as a purely resistive load as seen by the AC input line voltage. The degree to which the circuit appears as a pure resistive load is measured by the phase shift between the input voltage and the input current. Good power factor results are achieved when the input current wave form matches the shape of the sinusoidal input voltage. The cosine of the phase angle between the input voltage and the input current is defined as the power factor. The degree to which the shape of the input current wave form matches the shape of the input voltage wave form is determined by the total harmonic distortion. A power factor of 1.0 corresponds to zero-phase shift, or a purely resistive load. The total harmonic distortion of 0% represents a pure sinusoidal wave with no distortion of the wave form. Accordingly, the ballast design attempts to optimize these features by having a high power factor with a low total harmonic distortion. The power factor correction circuit incorporated into IC U1 modifies the AC line input current in accordance with the AC line input voltage to produce a high power factor and a low total harmonic distortion. Circuit 40 is a boost-type power factor correction circuit that is operated in critical conduction mode to permit inductor LPFC to discharge to zero in each switch cycle.

Switch MPFC is switched to achieved the power factor correction goals in the boost-type converter circuit 40. Switch MPFC typically switches at a much higher frequency, i.e., 100 kHz, than the input line frequency, which is typically 50–60 Hz. In each switching cycle, switch MPFC is off until inductor LPFC discharges to zero-current, at which point switch MPFC is turned on again, yielding critical conduction operation. When switch MPFC is turned on, inductor LPFC is connected between the rectified line input causing the current in inductor LPFC to charge up linearly. When switch MPFC is turned off, inductor LPFC is connected between the rectified line input and the DC bus capacitor CBUS through diode DPFC. The stored current in inductor LPFC then flows into capacitor CBUS. As switch MPFC is turned on and off at high frequency, the voltage on capacitor CBUS charges up to a specified voltage. The feedback loop in the circuit in IC U1 regulates the voltage to a specified fixed value by continuously monitoring the DC voltage and adjusting the on-time of switch MPFC accordingly. To increase the DC bus voltage, the on-time of switch MPFC is increased, and vice versa. This negative feedback control is performed with a low loop speed and a low loop gain so that the average inductor current smoothly follows the low frequency line input voltage to achieve a high power factor and a low total harmonic distortion. The on-time of switch MPFC therefore appears to be fixed over several cycles of the line voltage (see FIG. 13). With a fixed on-time, and an off-time determined by the inductor current discharging to zero, the result is a system where the switching frequency is free-running and constantly changing from a high frequency near the zero-crossing of the AC input line voltage, to a lower frequency at the peaks of the AC input line voltage.

Figure 10:
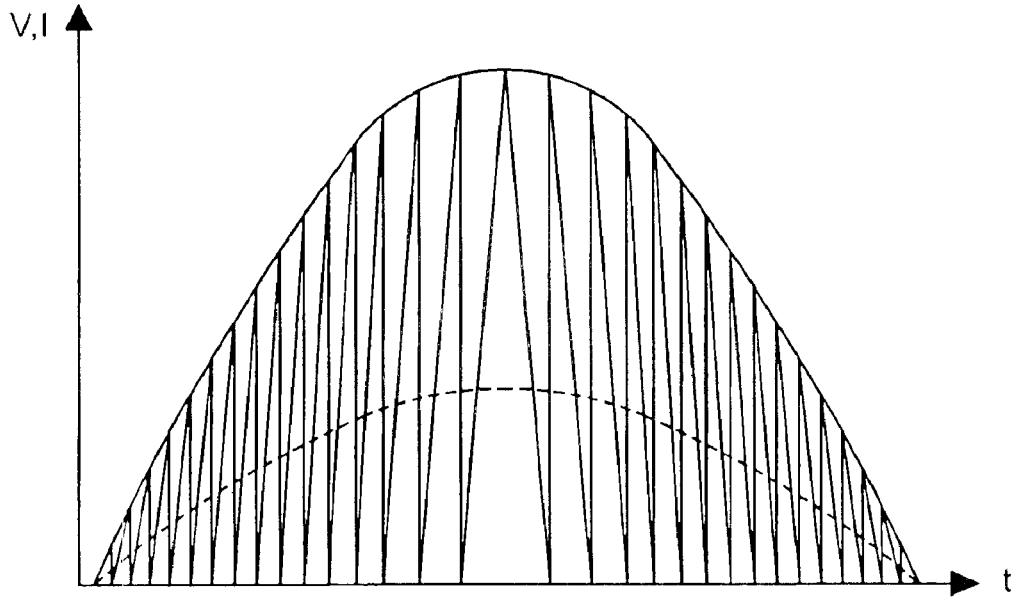
FIG. 10 is a graph showing input voltage and current with power factor correction.

This relationship is illustrated in FIG. 10, where the sinusoidal line input voltage is illustrated with a solid line. The current through inductor LPFC is triangular shaped with peaks coinciding with the sinusoidal line input voltage. The smoothed sinusoidal line input current is shown as a dashed line. In FIG. 10, a half-cycle of input line voltage is illustrated, with the line input current appearing to be sinusoidal in shape, and having the same frequency as the line input voltage.

When the line input voltage is low, i.e., near the zero-crossing, the current through inductor LPFC will charge only a small amount and therefore discharge quickly to result in a high switching frequency. When the input line voltage is high, i.e., near the peak of the sinusoidal shape, the current through inductor LPFC charges up to a higher amount, resulting in a correspondingly longer discharge time and a lower switching frequency. The triangular inductor current through inductor LPFC is smoothed through a filter to produce the sinusoidal line input current shown as a dashed line in the graph of FIG. 10.

Figure 11:
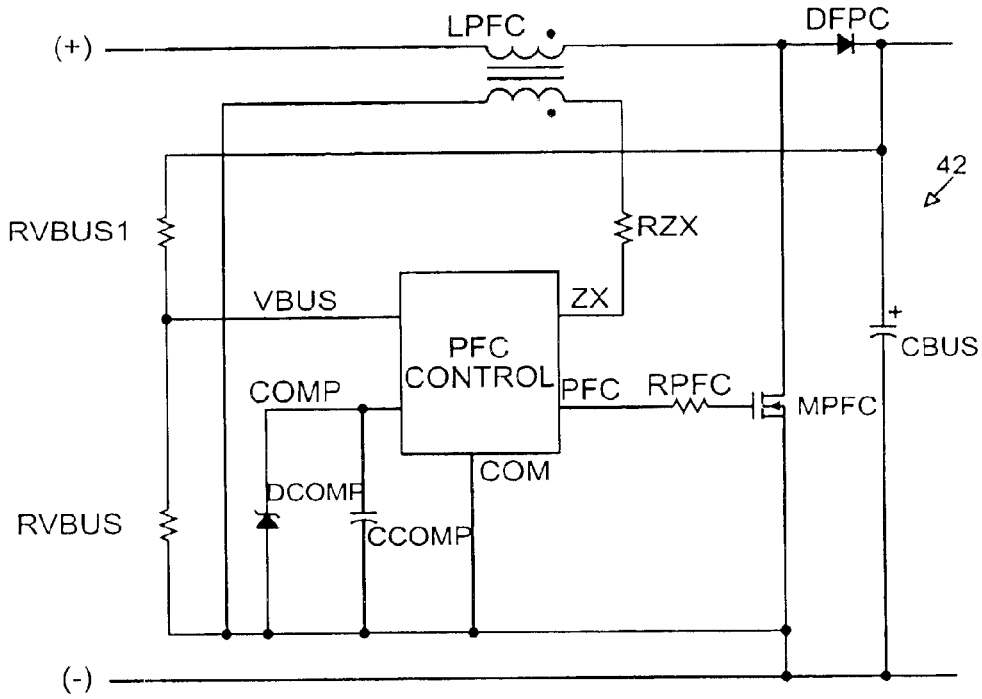
FIG. 11 is a circuit diagram illustrating power factor correction control circuitry.

Referring now to FIG. 11, a power factor correction control circuit is shown generally as circuit 42. Four connections to the circuit embodied in IC U1 are shown in the power factor correction control circuit of FIG. 11. The pin VBUS senses the DC bus voltage through the external resistor voltage divider comprised of resistor RVBUS1 and resistor RVBUS. Pin COMP obtains the selectable on-time for switch MPFC and the speed of the feedback loop. These features are selected through the dimensions of components zener diode DCOMP and capacitor CCOMP. Pin ZX detects the zero-crossing of the inductor current through inductor LPFC, indicating that inductor LPFC is totally discharged. As illustrated in FIG. 11, inductor LPFC has a secondary winding used to determine the zero-crossing as coupled with resistor RZX. Pin PFC provides the gate driver output for switch MPFC through resistor RPFC.

Figure 12:
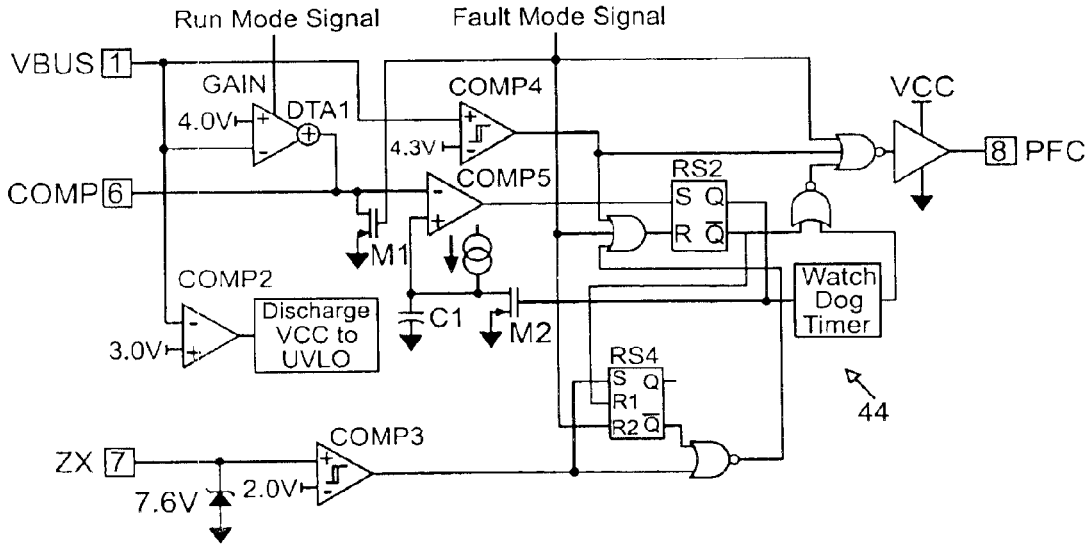
FIG. 12 is a schematic block diagram for power factor correction control and circuitry.

Referring now to FIG. 12, an internal diagram of the power factor correction control according to the present invention is illustrated generally as circuit 44. Pin VBUS is regulated with a 4.0 volt reference voltage to regulate the switching frequency applied to switch MPFC, and thus the DC bus voltage. The feedback loop operates through an operational transconductance amplifier (OTA) that sinks or sources a current to the external capacitor connected to pin COMP. The resulting voltage on pin COMP sets the threshold for charging the internal timing capacitor C1. The voltage on pin COMP therefore programs the on-time of switch MPFC. During preheat and ignition modes for ballast operation, the gain of the OTA is set to a high level to raise the DC bus voltage level quickly and minimize transients on the DC bus that can occur during ignition. During run mode, the gain of the OTA is decreased to a lower level to achieve a high power factor with low total harmonic distortion.

The off-time of switch MPFC is determined by the time it takes for the inductor LPFC to discharge the current to zero. The zero current level is detected through the secondary winding on inductor LPFC (FIG. 11), which is connected to pin ZX. A positive going edge exceeding the internal 2.0 volt reference on pin ZX signals the beginning of the off-time. A negative going edge on pin ZX falling below the level of 1.7 volts will occur when the inductor LPFC discharges its current to zero, which signals the end of the off-time, and switch MPFC is again turned on. The switching cycle repeats itself indefinitely while the ballast control operates in normal run mode. The PFC control can be disabled because of a detected fault, an over or under voltage condition on the DC bus, or if a negative transition on pin ZX does not occur. If a negative transition on pin ZX does not occur, switch MPFC will remain off until the watch-dog timer illustrated in circuit 44 forces switch MPFC to turn on for an on-time duration determined by the voltage received on pin COMP. The watch-dog timer pulses every 400 microseconds indefinitely until a correct positive and negative going signal is detected on pin ZX, and normal PFC control operation is resumed.

Figure 13:
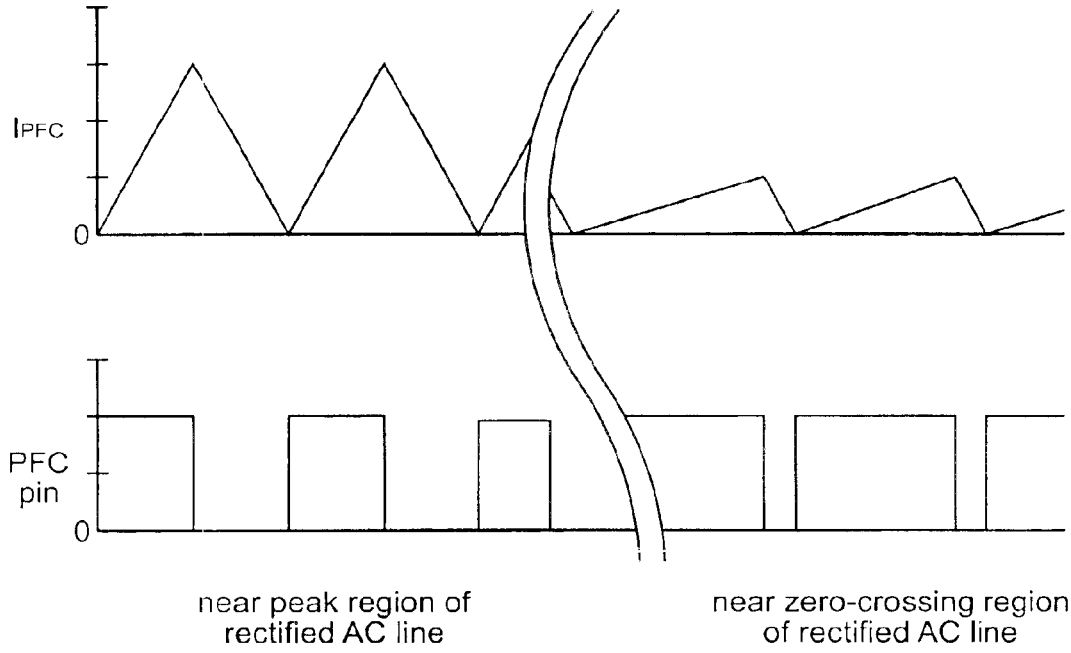
FIG. 13 is a graph showing operation of power factor correction control to reduce to total harmonic distortion.

A fixed on-time of switch MPFC over an entire cycle of the line input voltage produces a peak inductor current that naturally follows the sinusoidal shape of the line input voltage. The smoothed averaged line input current is in phase with the line input voltage to obtain high power factor. However, the total harmonic distortion, as well as the individual high harmonics of the current, can still be too high. The high distortion is mostly due to cross-over distortion of the line current near the zero-crossings of the line input voltage. To reduce the harmonics to a level acceptable with international standards and to meet general market requirements, an additional on-time modulation circuit is provided with the PFC control. This circuit dynamically increases the on-time of switch MPFC as the line input voltage approaches a zero-crossing. The on time modulation of switch MPFC is illustrated in the graph of FIG. 13. By dynamically increasing the on-time of switch MPFC, the peak current through inductor LPFC increases slightly near zero-crossings of the line input voltage. The smoothed line input current experiences a corresponding slight increase through this technique. By permitting the peak current through inductor LPFC to increase slightly, the amount of cross-over distortion in the line input current is reduced, thereby reducing the total harmonic distortion as well as the higher harmonics to desired or acceptable levels.

Referring again to FIG. 12, the power factor correction control circuit 44 offers over-voltage protection for the DC bus. If the voltage on VBUS exceeds the threshold set internally to 4.3 volts, for example, the output to switch MPFC is disabled, or latched to a low state. Once the DC bus voltage decreases so that the voltage on pin VBUS is below the internal threshold of 4.0 volts, a watch-dog timer pulse is forced on pin PFC and normal PFC operation resumes.

Circuit 44 also offers the protection of an under-voltage reset when the line input voltage decreases. Voltage decreases due to interrupted or brown-out conditions causes the on-time of switch MPFC to increase through the PFC feedback loop, in order to keep the voltage on the DC bus constant. If the on-time of switch MPFC increases too much, the peak current in inductor LPFC can exceed the saturation current limit of inductor LPFC. Inductor LPFC can then saturate to create very high peak currents and high di/dt levels.

To prevent this saturation occurrence, the maximum on-time for switch MPFC is limited by providing a limit to the maximum voltage on pin COMP with an external zener diode DCOMP. As the line input voltage decreases, the voltage on pin COMP, and therefore, the on-time of switch MPFC will eventually become limited. The PFC control can no longer supply enough current to keep the voltage on the DC bus fixed for the given load power drawn by the lamp, and the voltage on the DC bus will begin to drop.

As the line input voltage continues to decrease, the voltage on pin VBUS eventually decreases below the internal threshold of 3.0 volts, for example. When the voltage on pin VBUS decreases below this threshold level, VCC is discharged through an internal switch to ground so that the voltage on VCC is at or below UVLO-. When VCC reaches this level, IC U1 changes states to UVLO mode and the output drivers for switches M1, M2 and M3, as illustrated in circuit 30 in FIG. 3, are disabled, or latched to a low state.

The start-up supply resistor $R_{SUPPLY}$ connected to VCC together with the micro ampere start-up current used by IC U1, establish the voltage for turn-on given appropriate line input voltage. The line input turn-on voltage is determined such that the ballast turns on at a line voltage input level above the under-voltage turn-off level. By setting a different line input turn-on voltage and under-voltage turn-off level, the ballast provides an operational hysteresis for smooth transitions between on and off states. By selecting the resistive value of $R_{SUPPLY}$ on pin VCC and the voltage level of the zener diode DCOMP connected to pin COMP, the line input voltage levels for on and off thresholds for the ballast can be properly set. With these thresholds, the ballast will turn off when the voltage on pin VBUS is lower than the exemplary 3.0 volt internal threshold, and the ballast will turn on again at a higher line input voltage through the selection of the supply resistor $R_{SUPPLY}$. This hysteresis results in a smooth reset of the ballast, and avoids lamp flickering, DC bus bouncing or lamp extinguishing if the DC bus voltage becomes too low.

IC U1 illustrated in FIG. 2 is a 16 lead package that incorporates three discrete IC packages into one unit. A number of advantages are realized with this approach, including reduced manufacturing costs and the attendant testing and qualification processes that would be required for one IC instead of three. With this approach, only one supply voltage VCC is used instead of three, with an attendant reduction in external components that would be provided with the three IC configuration. In addition, the simplified PFC stage eliminates the need for external components that would otherwise be used to sense the AC line voltage in current. For example, an expensive current sense resistor is no longer needed through the use of a simplified PFC section, while protection resistors and charge pump components are also eliminated.

Referring to FIGS. 11 and 12, the simplified PFC circuitry uses only four pins on IC U1. No current sense input from the PFC switch is required. The amplifier error loop gain represented on pin COMP can have a high or low gain to provide for different operational situations, as described above. The PFC switch on time is increased when the line voltage approaches a zero crossing point to reduce crossover distortion. The on time of the PFC switch is determined from the error amplifier that senses the bus voltage on the VBUS pin. The PFC switch off time is determined with the current on inductor LPFC through the input on the ZX pin. The error loop amplifier gain is set to be high when the circuit initializes, to allow the DC bus voltage to rise rapidly. The gain is also high when the lamp is ignited so that the associated high current surge creates only a small transient in the DC bus voltage.

The resulting ballast control on a single integrated circuit reduces manufacturing and design costs while providing a robust operation. Power factor correction is provided in conjunction with ballast control, and has a variable gain dependent upon operational status of the ballast controller. The PFC section is disabled in particular fault modes to protect the PFC section and the electronic ballast. The reduction in circuitry, supply voltage, components and sensitive design operation helps to simplify the overall design while obtaining high performance with excellent reliability.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An integrated circuit for an electronic ballast control, comprising:

half-bridge control circuitry for driving a power half-bridge in the electronic ballast;

ballast control circuitry coupled to the half-bridge control circuitry and operable to provide signals to the half-bridge control circuitry to control operation of the half-bridge control circuitry;

an input coupled to the ballast controlled circuitry and indicative of at least one of a state of power supplied to the electronic ballast and a state of an electronic ballast load, the ballast control circuitry controlling the half-bridge control circuitry based on the input; and power fractor control circuitry coupled to the ballast control circuitry and operable to regulate ballast power to obtain an improved power factor correction for the ballast, wherein the power factor control circuitry is selectively operable at a high gain to obtain a fast response or at a low gain for power factor correction optimization.

2. The integrated circuit according to claim 1, wherein:

the half-bridge control circuitry includes an output for a high and a low half-bridge switch; and the low side output is referenced to a voltage common to the integrated circuit.

3. The integrated circuit according to claim 1, wherein the power factor control circuitry includes a switch, an on time of the switch being increased when a voltage of the input power approaches zero.

4. The integrated circuit according to claim 1, wherein the power factor control circuit includes a boost type power converter operated in critical conduction mode.

5. An integrated circuit for an electronic ballast control, comprising:

half-bridge control circuitry for driving a power half-bridge in the electronic ballast;

ballast control circuitry coupled to the half-bridge control circuitry and operable to provide signals to the half-bridge control circuitry to control operation of the half-bridge control circuitry;

an input coupled to the ballast controlled circuitry and indicative of at least one of a state of power supplied to the electronic ballast and a state of an electronic ballast load;

the ballast control circuitry controlling the half-bridge control circuitry based on the input; and power factor control circuitry coupled to the ballast control circuitry and operable to regulate ballast power to obtain an improved power factor correction for the ballast, wherein the power factor control circuitry includes a switch, an on time of the switch being increased when a voltage of the input power approaches zero.

6. The integrated circuit according to claim 5, wherein the power factor control circuitiy is selectively operable at a high gain to obtain a fast response or at a low gain for power factor correction optimization.

7. The integrated circuit according to claim 5, wherein the power factor control circuit includes a boost type power converter operated in critical conduction mode.

8. A power factor correction circuit integrated into an electronic ballast, the power factor correction circuit comprising:

an input voltage sensing section for sensing input voltage to the electronic ballast;

an inductor current sensing section for detecting a zero current crossing of an inductor;

a variable gain control section coupled to the input voltage sensing section and operable to provide variable closed loop feedback gain in the power factor correction circuit;

a compensation indication coupied to the variable gain control section for influencing a closed loop gain of the variable gain control section;

an output section coupled to the variable gain control section and the inductor sensing section for driving a power factor correction switch, an on time of the output section being related to the input voltage, the variable closed loop gain and the zero current crossing.

9. The circuit according to claim 8, further comprising a fault signal input for disabling the output section when a fault is detected.

10. The circuit according to claim 8, wherein the circuit output is coupled to a switch that is coupled to the inductor and controls charging and discharging of the inductor.

11. The integrated circuit according to claim 8, wherein the power factor control circuit includes a boost type power converter operated in critical conduction mode.

12. An integrated circuit for an electronic ballast controll comprising:

half-bridge control circuitry for driving a power half-bridge in the electronic ballast;

ballast control circuitiy coupled to the half-bridge control circuitry and operable to provide signals to the half-bridge control circuitry to control operation of the half-bridge control circuitry;

an input coupled to the ballast controlled circuitry and indicative of at least one of a state of power supplied to the electronic ballast and a state of an electronic ballast load;

the ballast control circuitry controlling the half-bridge control circuitry basod on the input; and power factor control circuitry coupled to the ballast control circuitry and operable to regulate ballast power to obtain an improved power factor correction for the ballast, wherein the power factor control circuit includes a boost type power converter operated in critical conduction mode.

13. The integrated circuit according to claim 12, wherein the power factor control circuitry includes a switch, an on time of the switch being increased when a voltage of the input power approaches zero.

14. The integrated circuit according to claim 12, wherein the power factor control circuitry is selectively operable at a high gain to obtain a fast response or at a low gain for power factor correction optimization.

15. A method for controlling an electronic ballast, comprising:

sensing a zero crossing of an input voltage;

increasing a switch on time as the input voltage approaches the zero crossing to provide for power factor correction with reduced crossover distortion;

increasing a gain of a power factor correction loop to obtain a fast response;

reducing a gain of a power factor correction loop to optimize ballast power factor; and controlling an inductor by activating a switch in a boost type power factor correction circuit.

16. The method according to claim 15, further comprising disabling the power factor correction circuitry when a fault is detected in the electronic ballast.

* * * * *